US008783985B2

(12) United States Patent
Rogge et al.

(10) Patent No.: US 8,783,985 B2
(45) Date of Patent: Jul. 22, 2014

(54) PRINTING PRESS COMPRISING SOUND ABSORBING ELEMENTS

(75) Inventors: Uwe Rogge, Lengerich (DE); Frank Gunschera, Osnabrueck (DE)

(73) Assignee: Windmoeller & Hoelscher KG, Lengerich (DE)

( * ) Notice: Subject to any disclaimer, the term of this patent is extended or adjusted under 35 U.S.C. 154(b) by 417 days.

(21) Appl. No.: 12/736,978

(22) PCT Filed: May 27, 2009

(86) PCT No.: PCT/EP2009/003752
§ 371 (c)(1),
(2), (4) Date: Feb. 10, 2011

(87) PCT Pub. No.: WO2009/146822
PCT Pub. Date: Dec. 10, 2009

(65) Prior Publication Data

US 2011/0132219 A1 Jun. 9, 2011

(30) Foreign Application Priority Data

May 29, 2008 (DE) ..... 10 2008 025994

(51) Int. Cl.
*B41J 29/08* (2006.01)
*B41F 5/24* (2006.01)
*B41F 13/42* (2006.01)
*B41F 13/00* (2006.01)

(52) U.S. Cl.
CPC ..... *B41F 13/0024* (2013.01); *B41F 5/24* (2013.01); *B41P 2213/44* (2013.01); *B41F 13/42* (2013.01)
USPC ..... 400/690; 400/690.4

(58) Field of Classification Search
USPC ..... 400/690
See application file for complete search history.

(56) References Cited

U.S. PATENT DOCUMENTS 2,502,016 A * 3/1950 Olson ..... 181/295
3,787,986 A * 1/1974 Burger ..... 34/229
4,836,701 A * 6/1989 Gates ..... 400/617
4,943,173 A * 7/1990 Okazaki et al. ..... 400/689
4,976,391 A * 12/1990 Jessen et al. ..... 242/615.3

(Continued)

FOREIGN PATENT DOCUMENTS

DE 199 54 458 A1 5/2001
DE 101 01 129 B4 8/2001

(Continued)

OTHER PUBLICATIONS

Kippan, H., "Handbuch der Printmedien—Technologien und Produktionsverfahren," Springer Verlagm XO992547935, pp. 163-165 (2000)(cited in International Search Report, no English version available).

*Primary Examiner* — Anthony Nguyen
(74) *Attorney, Agent, or Firm* — Jacobson Holman, PLLC.

(57) ABSTRACT

A printing machine has at least one central impression cylinder, to which several inking units are allocated, in which a printing material sheet can be fed along a feed path to the impression cylinder in an area between a first inking unit and a last inking unit, and an unwinding station, from which the printing material sheet can be unwound, in which a passable area is provided between the impression cylinder and the unwinding station, at which the printing material sheet can be passed. Sound-absorbing elements are arranged above and/or beneath the feed path.

13 Claims, 1 Drawing Sheet

(56) References Cited

U.S. PATENT DOCUMENTS

| | | | | |
|---|---|---|---|---|
| 5,158,378 | A * | 10/1992 | Takada et al. | 400/124.01 |
| 5,178,069 | A * | 1/1993 | Rodi | 101/480 |
| 5,865,119 | A * | 2/1999 | Michalik | 101/480 |
| 5,970,866 | A * | 10/1999 | Okawa | 101/118 |
| 6,176,184 | B1 * | 1/2001 | Mudry | 101/424.1 |
| 6,505,419 | B2 | 1/2003 | Poetter | |
| 6,631,784 | B2 | 10/2003 | Hieb et al. | |
| 7,217,186 | B2 * | 5/2007 | Basset et al. | 454/187 |
| 7,415,428 | B2 * | 8/2008 | Garwood | 705/26.5 |
| 8,336,672 | B2 * | 12/2012 | Derks et al. | 181/224 |
| 2006/0288603 | A1 | 12/2006 | Ronecker et al. | |

FOREIGN PATENT DOCUMENTS

| | | | |
|---|---|---|---|
| DE | 100 34 708 | A1 | 1/2002 |
| DE | 10 2005 025 776 | A1 | 12/2006 |
| EP | 0 166 241 | A2 | 1/1986 |

* cited by examiner

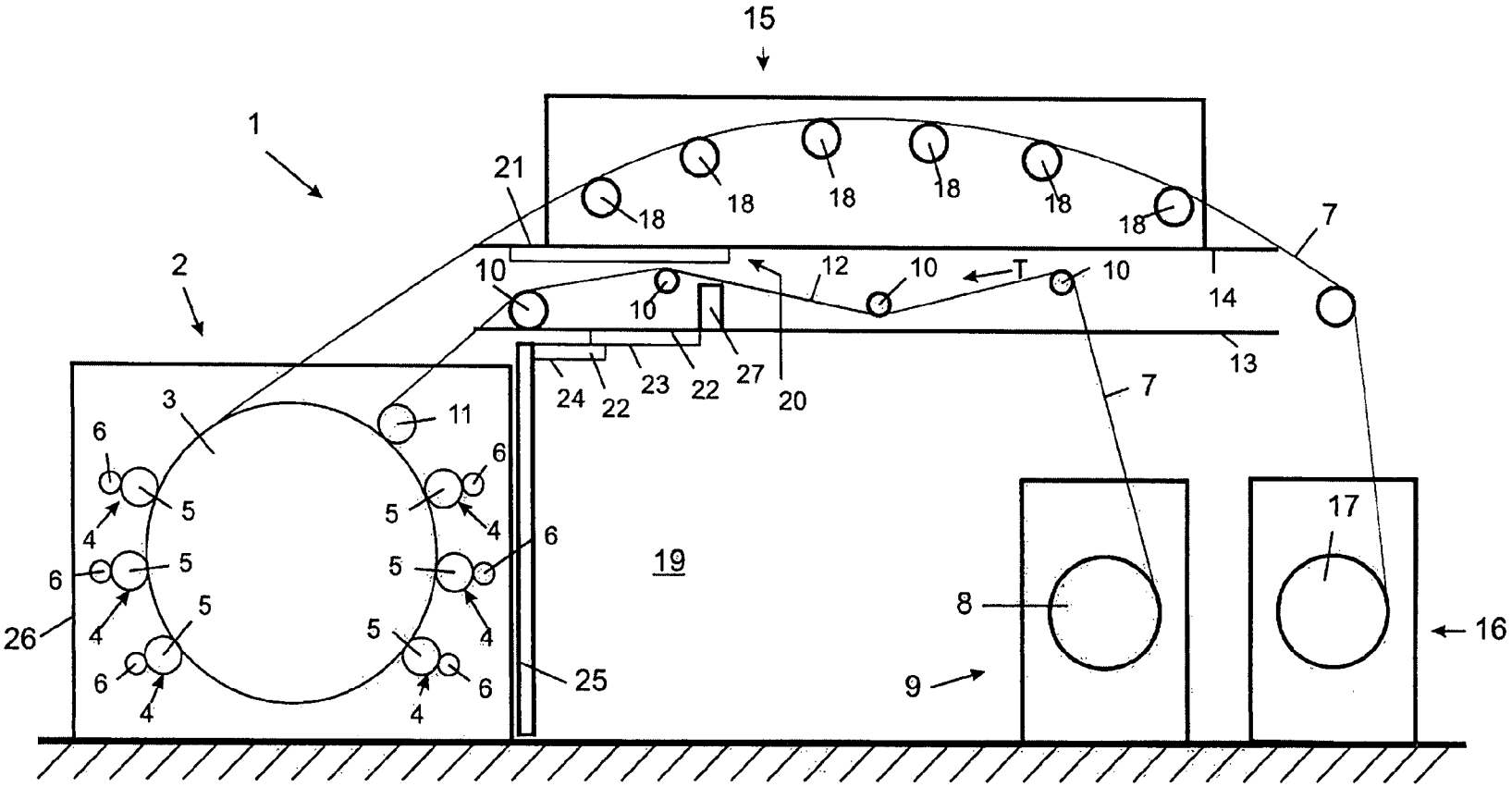
1
2
3
4
5
6
7
8
9
10
11
12
13
14
15
16
17
18
19
20
21
22
23
24
25
26
27
T

PRINTING PRESS COMPRISING SOUND ABSORBING ELEMENTS

CROSS-REFERENCE TO RELATED APPLICATIONS

This is a national stage of PCT/EP09/003752 filed May 27, 2009 and published in German, which claims the priority of German number 2008 025 994.2 filed May 29, 2008, hereby incorporated by reference.

BACKGROUND OF THE INVENTION

1. Field of Invention

The invention concerns a printing machine having at least a central impression cylinder, to which several inking units are allocated, in which a printing material sheet can be supplied to the impression cylinder in the area between the first inking unit and the last inking unit along a feed path.

2. Description of the Prior Art

Printing machines with a central impression cylinder and inking units arranged around it are adequately known and are used mostly to print sheet-like printing materials according to the flexographic printing method. These sheet-like printing materials are generally used to produce packaging.

The sheet-like material can be unwound for this purpose from an unwinding station and fed to the impression cylinder on a feed path. The area between the unwinding station and the impression cylinder is generally passable. This is important, in particular, in order to be able to supply the unwinding station with a new sheet reel, when the previous sheet reel is used up. However, this area must also be passable by operating personnel for sheet observation.

Since flexographic printing is a letterpress method, the areas being printed are raised relative to the areas not being printed. The transition between areas not being printed and the areas being printed is referred to as starting edge. The areas being printed are made from flexible material, which is generally slightly compressed when the starting edge strikes the printing material. The material expands when the area being printed is no longer in contact with the printing material.

This dynamic causes oscillations of the plate that the areas being printed represent. These oscillations propagate as sound into the surroundings, so that a significant noise burden can occur in the area of the printing machine. The noise level can surpass the acceptable burden for operating personnel precisely in the passable area described in the previous paragraph between the unwinding station and the impression cylinder.

SUMMARY OF THE INVENTION

The task of the present invention is therefore to improve the printing machine initially described, so that the noise level is reduced.

This task is solved according to the invention by the features thereof that are described herein. Sound-absorbing elements are provided, which are arranged above and/or beneath the feed path. The sound-absorbing elements have the properties of absorbing sound waves and converting them within the solid to other forms of energy or at least to oscillations of different frequencies, so that the sound waves audible to humans are apparently destroyed.

The invention is based on the observation that the high sound level, especially in the passable area, comes about because the sound generated in the area of the inking units is reflected on the bottom of a so-called drying box, in which the already printed sheet is dried, and which bounds the feed path on the top. The reflected sound then goes into the passable area, for which reason the operating personnel present in this area are severely burdened.

It has been found that with the arrangement of sound-absorbing elements according to the invention, the sound level could be significantly reduced precisely in the passable area.

It is particularly advantageous, if the sound-absorbing elements extend in the direction of the feed path. Since the sound source is not a point source, but the entire printing unit with all its inking units is viewed as a spatially extensive sound source, the sound is also reflected on different locations. Particularly effective sound reduction can therefore be achieved with elements selected sufficiently large.

A particularly preferred embodiment of the invention includes support plates, on which the sound-absorbing elements are mounted. Such support plates can be mounted at a spacing beneath the drying box, so that sound waves that are directly reflected from the printing material can be absorbed.

It is particularly advantageous, if the sound-absorbing elements form a tunnel, through which the feed path runs. In this case, the feed path is provided on all sides with sound-absorbing material, so that even more sound can be absorbed.

Elements made of different materials are considered as sound-absorbing elements. Foam material can be mentioned especially here, which often consists of plastic, which was foamed with a propellant gas, so that small bubbles from the propellant gas are then included in the material. This included gas leads overall to softness and therefore sound-absorbing properties of the material. A material from a polyester-polyurethane-based foam is preferably used. Another preferred material is an elastic synthetic resin-bonded mineral wool material.

Further practical examples of the invention are apparent from the substantive description and the claims.

BRIEF DESCRIPTION OF THE DRAWINGS

The single FIGURE shows a side view of a printing machine according to the invention.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

As shown in the drawing FIGURE, a printing machine 1 includes a printing unit 2, which has a central impression cylinder 3. The impression cylinder 3 is mounted to rotate in a machine frame (not shown). Brackets that represent the supports for the inking units 4 are also not shown. Of the inking units 4, only the printing cylinder 5 and the ink transfer rollers, for example, anilox rollers 6, are shown. In the area of the printing mechanism 2, considerable sound is generated during operation, which leads to a very severe noise burden.

The printing material sheet 7 is made available in the printing machine on a reel 8, which is mounted to rotate in an unwinding station 9. The unwound printing material sheet 7 is guided via several guide rollers 10 from the unwinding station 9 to the pressure roller 11, with which the printing material sheet 7 can be applied to the impression cylinder. The sheet path between the unwinding station 9 and the pressure roller is considered the feed path 12 of the printing material sheet 7. The feed path 12 is bounded in a large area by supports 13 and 14 in height. These supports can be the horizontal parts of double-T supports. The guide rollers 10 are arranged between the elements connecting the supports. Two supports 13 are provided on both sides of the sheet edges (not shown). Two supports 14 are also provided.

After the printing material sheet 7 has passed through the printing unit 2, it is fed to the drying box 15. There it is passed by dryers (not shown) and/or other devices that serve to cure the printing ink via numerous guide rollers 18. After leaving the drying box, the sheet 7 is fed to the winding station 16, where it is further processed to a reel 17. The sheet 7 is always guided between the printing unit 2 and the winding station 16, so that it lies with the unprinted side on the guide rollers 18.

A passable area 19 exists between the winding station 9 and the printing unit 2, which is often traversed by operating personnel, in order to perform various tasks. The sound emitted by the printing unit 2 and reflected from the bottom 20 of the drying box, for the most part, reaches this passable area. To reduce this sound, the bottom of the drying box is provided with a mat 21 of sound-absorbing or sound-damping material. This mat 21 is preferably as wide as the drying box. The length in the direction of the feed path 12 can be chosen to correspond to the requirements for sound reduction and, for example, amounts to one meter.

In order to further dampen the sound, connection elements are also provided beneath the feed path 12 between the two supports 13, for example, sheets, which are covered with mats 22 of sound-damping materials. The sound directed toward the passable area 19 can then be dampened, which leads to a reduced sound burden in this area 19.

The support element 24 also carries sound-damping material. The support element 24, however, is not fastened to the supports 13, but to the sliding element 25 or sliding elements 25. The sliding element or each sliding element advantageously also includes sound-damping material. Glass serves as sound-damping material here, which also offers the advantage that the printing unit can be observed. Since the support element 24 is arranged on the sliding element 25, it can be displaced with the sliding element 25 in the axial direction of the printing cylinder 5, so that the printing unit 2 is accessible, for example, for maintenance purposes.

All gaps, for example, between the support element 24 and the connection 23 or between the sliding element 25 and the housing 26 of the printing unit 2, are acoustically sealed by brushes made of soft bristles, so that sound emission can be further reduced in the passable area 19.

The elements that connect supports 13 and 14, i.e., the vertical elements of the double-T supports, can also be covered with sound-damping material, so that the feed path leads through an actual tunnel of sound-damping material.

The entry area of the area covered with sound-damping material can be further narrowed by a constriction element 27. The constriction element 27 can be a transverse support, to which the connection element 23 can be fastened.

The constriction element 27 already has a damping effect on sound, but can additionally be covered with sound-damping materials.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numbers | |
|---|---|
| 1 | Printing machine |
| 2 | Printing unit |
| 3 | Impression cylinder |
| 4 | Inking unit |
| 5 | Printing cylinder |
| 6 | Anilox roller |
| 7 | Printing material sheet |
| 8 | Reel |
| 9 | Unwinding station |
| 10 | Guide roller |
| 11 | Pressure roller |
| 12 | Feed path |
| 13 | Support |
| 14 | Support |
| 15 | Drying box |
| 16 | Winding station |
| 17 | Reel |
| 18 | Guide roller |
| 19 | Passable area |
| 20 | Bottom of drying box |
| 21 | Mat made of sound-absorbing material |
| 22 | Mat made of sound-absorbing material |
| 23 | Connection element |
| 24 | Support element |
| 25 | Sliding element |
| 26 | Housing |
| 27 | Constriction element |
| T | Transport direction of sheet 7 |

What is claimed is:

1. A printing machine comprising:

at least a central impression cylinder, to which a plurality of inking units are allocated, in which a printing material sheet is supplied to the central impression cylinder in an area between a first inking unit and a last inking unit along a feed path;

an unwinding station, from which the printing material sheet is unwound;

a passable area between the central impression cylinder and the unwinding station, at which the printing material sheet is passed; and sound-absorbing elements configured as a tunnel, through which the feed path extends, with an entry area of the sound-absorbing elements including a component that narrows a cross section of the feed path, said component being located at an end of the tunnel that is generally adjacent the central impression cylinder.

2. The printing machine according to claim 1, wherein the sound-absorbing elements extend in a direction of the feed path.

3. The printing machine according to claim 1, wherein the sound-absorbing elements are mounted on support elements fastened to a frame of the printing machine.

4. The printing machine according to claim 1, wherein the component that narrows the cross section of the feed path extends across the tunnel in a direction that is substantially perpendicular to the feed path of the printing material that is being transported.

5. The printing machine according to claim 1, further comprising sound-absorbing elements that delimit a space between the central impression cylinder and the passable area from each other.

6. The printing machine according to claim 1, wherein the sound-absorbing elements include a foam.

7. A printing machine comprising:

at least a central impression cylinder, to which a plurality of inking units are allocated, in which a printing material sheet is supplied to the central impression cylinder in an area between a first inking unit and a last inking unit along a feed path;

an unwinding station, from which the printing material sheet is unwound;

a passable area between the central impression cylinder and the unwinding station, at which the printing material sheet is passed;

sound-absorbing elements configured as a tunnel, through which the feed path extends; and at least one sliding element having a support element associated therewith, said support element including thereon a sound-absorbing element.

8. The printing machine according to claim 7, wherein the at least one sliding element and the support element are displaceable in an axial direction of the central impression cylinder.

9. The printing machine according to claim 7, wherein the at least one sliding element includes a sound-absorbing element.

10. The printing machine according to claim 7, wherein a gap between the at least one sliding element and a housing of the central impression cylinder is acoustically sealed with a brush constructed of soft bristles.

11. A printing machine comprising:

at least a central impression cylinder, to which a plurality of inking units are allocated, in which a printing material sheet is supplied to the central impression cylinder in an area between a first inking unit and a last inking unit along a feed path;

an unwinding station, from which the printing material sheet is unwound;

a passable area between the central impression cylinder and the unwinding station, at which the printing material sheet is passed;

sound-absorbing elements configured as a tunnel, through which the feed path extends; and at least one sliding element having a support element associated therewith, said support element including thereon a sound-absorbing element, with an entry area of the sound-absorbing elements including a component that narrows a cross section of the feed path, said component extending across the tunnel in a direction that is substantially perpendicular to the feed path of the printing material that is being transported.

12. The printing machine according to claim 11, wherein the at least one sliding element provides access to a housing in which the central impression cylinder is located.

13. The printing machine according to claim 12, wherein the at least one sliding element is displaceable in an axial direction of the central impression cylinder, and wherein a gap between the at least one sliding element and the housing is acoustically sealed with a brush constructed of soft bristles.

* * * * *